US006313754B1

(12) United States Patent
Shimomura et al.

(10) Patent No.: US 6,313,754 B1
(45) Date of Patent: Nov. 6, 2001

(54) ESCAPE LIGHT INSTRUMENT

(75) Inventors: Yoko Shimomura, Ikoma; Masanori Shimizu, Kyotanabe; Yoshinori Tanabe, Hirakata, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/455,869

(22) Filed: Dec. 7, 1999

(30) Foreign Application Priority Data

Dec. 7, 1998 (JP) ..... 10-346265

(51) Int. Cl.[7] ..... G08B 5/00

(52) U.S. Cl. ..... 340/815.65; 313/486; 313/487; 252/301.4 P; 362/230; 362/231

(58) Field of Search ..... 340/815.65; 313/486, 313/485, 487, 503; 252/301.4 P, 301.4 R, 301.4 H; 362/230, 231

(56) References Cited

U.S. PATENT DOCUMENTS 4,079,287 * 3/1978 Soules ..... 313/487
4,176,294 * 11/1979 Thornton ..... 313/485
4,199,707 * 4/1980 Akiyama ..... 313/487
5,164,715 * 11/1992 Kashiwabara ..... 340/815.65
5,838,101 * 11/1998 Pappalardo ..... 313/487
6,153,971 * 11/2000 Shimizu et al. ..... 313/486

FOREIGN PATENT DOCUMENTS 02085883 3/1990 (EP) .
0717234 6/1996 (EP) .
0794556 9/1997 (EP) .
WO97/11480 3/1997 (WO) .
WO98/36441 8/1998 (WO) .

* cited by examiner

*Primary Examiner*—Daniel J. Wu
*Assistant Examiner*—Anh La
(74) *Attorney, Agent, or Firm*—Ratner & Prestia

(57) ABSTRACT

An escape light instrument using as its light source a fluorescent lamp, mainly derives its luminescence from luminophors the peak ranges of whose luminescent wavelength are from 530 to 580 nm and from 600 to 650 nm, said luminophors having 30 nm or less of half band width, wherein a luminous flux derived from a luminophor the peak range of whose luminescent wavelength is from 420 to 470 nm accounts for 4 to 10% of a total luminous flux in said main luminescent wavelength, and which permits categorical discrimination of at least green and white transmitted colors used on the sign face, and has a luminous color of 5 or more in Duv.

10 Claims, 9 Drawing Sheets

ESCAPE LIGHT INSTRUMENT

BACKGROUND OF THE INVENTION

1. Field of the Invention

The present invention relates to an escape light instrument for guiding people to emergency exits, shelters or the like in the event of an emergency such as a fire or an earthquake.

2. Related art of the Invention

Recently, large underground shopping malls and large buildings are increasing every year, and should a fire arise in such a place, the people present there would be psychologically shocked even more seriously than in a conventional building. In this connection, the importance of fire prevention and fire fighting is pointed out in many quarters. One of the factors having particularly contributed to this awareness may be the tremendous social impact of tragic press reports on the victims of fires involving large structures until 1965.

It was under such a circumstance that the Japanese Fire Service Law was revised to require specified objects of fire prevention, including high-rise buildings, to be equipped with large and medium-size escape lights which excel in visibility over conventional ones in order to take fast refuge when a fire arises. As a result, the newly installed escape lights have proved more effective, but their aesthetic disharmony with the interior designs of buildings is often criticized, and their improvement is urged in this respect.

To meet this requirement, research and development attempts have been undertaken to work out escape lights with smaller sign faces with the finding that the conspicuity of an escape light is determined by the product of the brightness and square measure of the sign face, and accordingly it is now urged to increase the luminance of the sign face in order to make such small escape lights available for practical use.

FIG. 9 illustrates the configuration of an escape light instrument.

The sign face of an escape light panel 1 comprises a white part 1*a*, which presents the background color, and a green part 1*b*, on which a guidance sign is drawn. Behind the sign face of the escape light panel 1 is arranged a fluorescent lamp 2, which serves as the light source, in a body 3.

The fluorescent lamp 2 in conventional use would be a white fluorescent lamp for general illumination use, and the spectral characteristics of such a white fluorescent lamp are designed so as to evaluate the fidelity of subtle color reproduction for various kinds of colors for a reference light source (blackbody radiation, synthetic daylight) according to the general color rendering index (Ra).

More specifically, by making the lights of visible wavelength bands the emission spectrum of bi-wavelength emission type concentrated on the bi-wavelength bands such fluorescent lamps include a white fluorescent lamp having a wide band type emission spectrum (hereinafter called a "white fluorescent lamp (FL-W)") and a tri-band type fluorescent lamp having a tri-band type emission spectrum (hereinafter called a "tri-band type fluorescent lamp (EX-N)").

However, the white fluorescent lamp (FL-W) or tri-band type fluorescent lamp (EX-N) mentioned above has a content of a superfluous wavelength band for the discrimination of white and green the discrimination of which is required for any escape light instrument. Therefore when these lamps are used as the light source of the escape light instrument, light flux(luminous efficiency [lm/W]) for supplied power is small.

SUMMARY OF THE INVENTION

An object of the present invention is to solve the above-noted problems and to realize such escape light instrument having high luminous efficiency.

An escape light instrument using as its light source a fluorescent lamp, of the present invention mainly derives its luminescence from luminophors the peak ranges of whose luminescent wavelength are from 530 to 580 nm and from 600 to 650 nm, said luminophors having 30 nm or less of half band width, permits categorical discrimination of at least green and white transmitted colors used on a sign face, and has a luminous color of 5 or more in Duv.

Such constitution of the present invention realizes escape light instrument having high luminous efficiency.

Accordingly when the luminance is same as that of the conventional instrument, the power can be reduced. When the power is same as that of the conventional instrument, the luminance of the present invention is higher.

Further when higher luminance than that of the conventional instrument is realized, and when the size of the instrument is same as the conventional one, the conspicuity is improved and when the conspicuity is same as the conventional one, the size can be reduced, that is, compact escape light instrument can be realized because the conspicuity of the escape light instrument is determined by the product of the luminance and area size of the display surface.

DESCRIPTION OF SYMBOLS

Figure 1A:
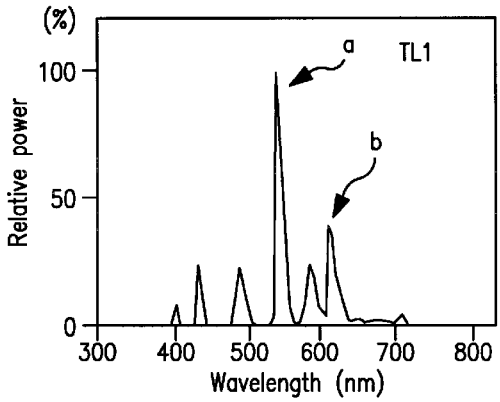
FIG. 1 shows spectral distributions of fluorescent lamps.
Figure 1D:
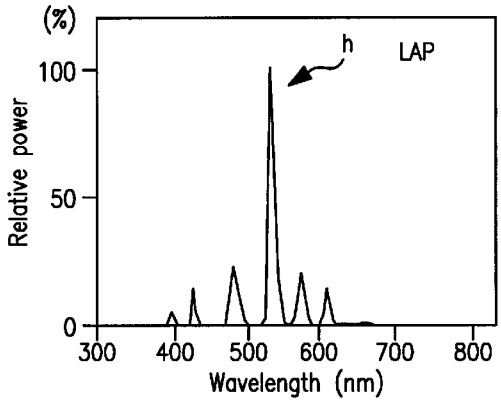
FIG. 1(d) PRIOR ART
Figure 1B:
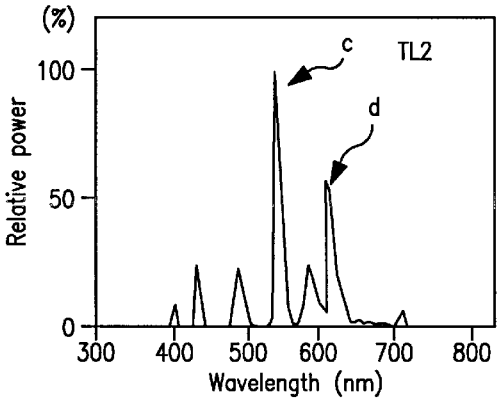
Figure 1E:
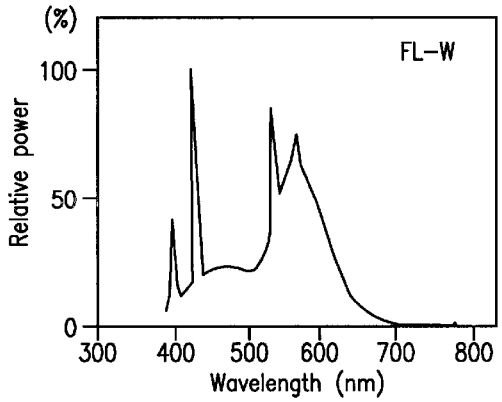
FIG. 1(e) PRIOR ART
Figure 1C:
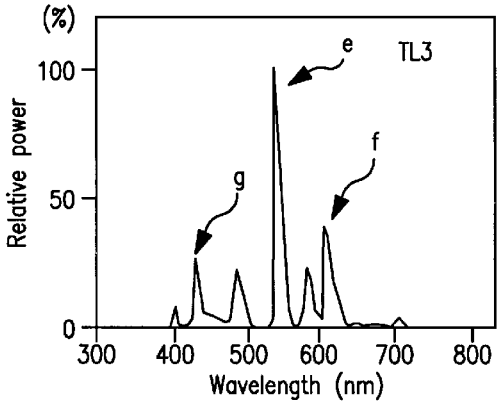
Figure 1F:
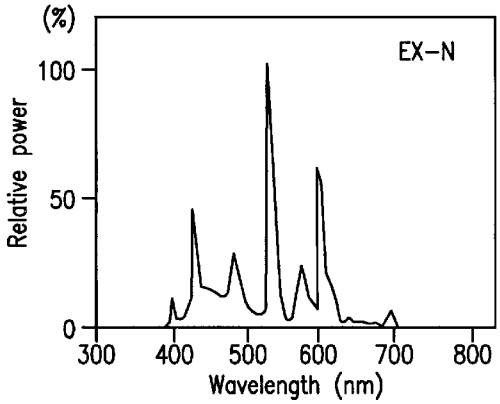
FIG. 1(f) PRIOR ART

1 Escape light panel
1*a* White part of the sign face
1*b* Green part of the sign face
2 Fluorescent lamp
3 Body

DETAILED DESCRIPTION OF THE PREFERRED EMBODIMENTS

An escape light instrument described in a first present invention uses as its light source a fluorescent lamp which mainly derives its luminescence from luminophors the peak ranges of whose luminescent wavelength are from 530 to 580 nm and from 600 to 650 nm, said luminophors having 30 nm or less of half band width, permits categorical discrimination of at least green and white transmitted colors used on the sign face, and has a luminous color of 5 or more in Duv.

An escape light instrument described in a second present invention uses as its light source a fluorescent lamp which mainly derives its luminescence from luminophors the peak ranges of whose luminescent wavelength are from 530 to 580 nm and from 600 to 650 nm, said luminophors having 30 nm or less of half band width ,in which a luminous flux derived from a luminophor the peak range of whose luminescent wavelength is from 420 to 470 nm accounts for 4 to 10% of the total luminous flux in the aforementioned main luminescent wavelength, which permits categorical discrimination of at least green and white transmitted colors used on the sign face, and has a luminous color of 5 or more in Duv.

An escape light instrument described in a third present invention is in the first or second present invention a spectral transmittance of 485 to 585 nm of a white part of a transmissive cover of the escape light instrument is lower than a 380 to 780 nm average spectral transmittance of said white part of said transmissive cover.

An escape light instrument described in a fourth present invention is an escape light instrument for transmissively illuminating its sign face having green and white color with a fluorescent lamp as the light source, wherein a fluorescent lamp permitting categorical discrimination of at least green and white transmitted colors is used as the aforementioned fluorescent lamp.

An escape light instrument described in a fifth present invention is in the fourth present invention, a blue emitting luminous flux of the fluorescent lamp is reduced against a tri-band type fluorescent lamp having correlated color temperature equivalent to that of said fluorescent lamp.

Various modes of implementing the present invention will be described below with reference to FIG. 1 through FIG. 8.

Practical Embodiment 1

Figure 9:
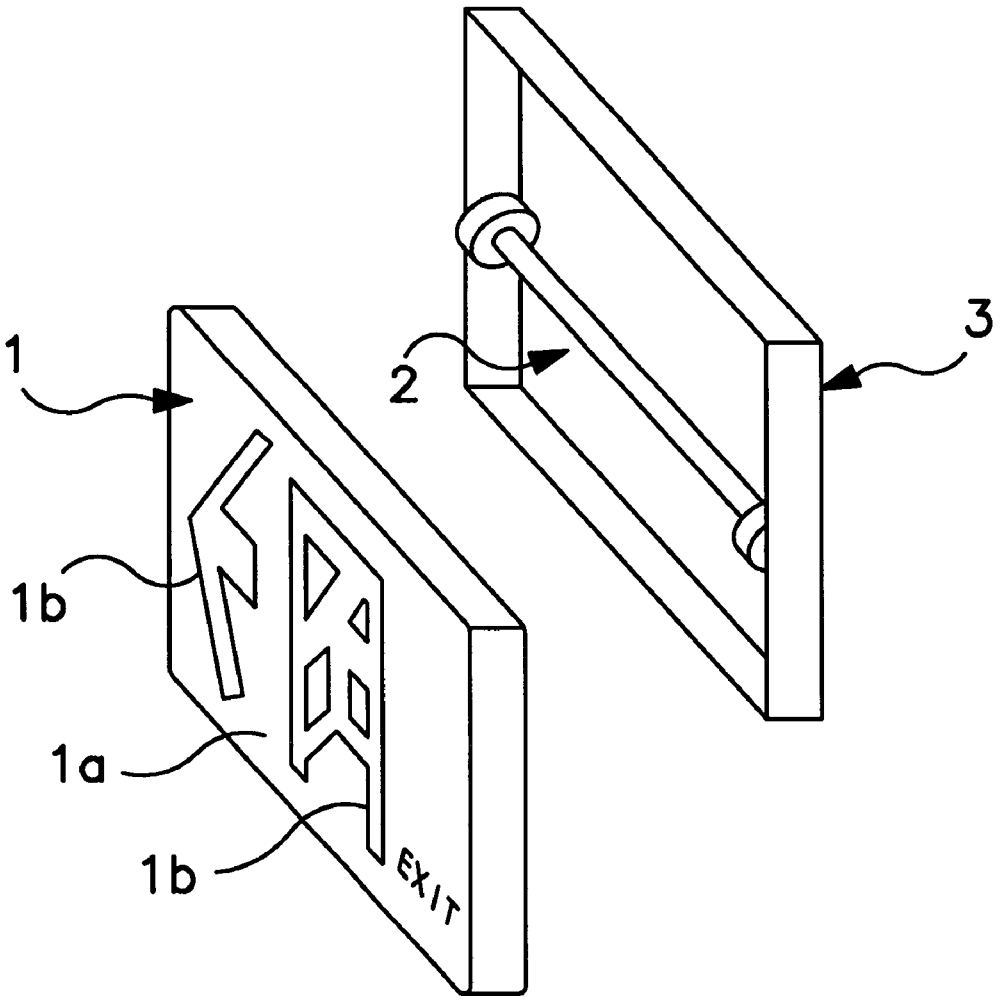
FIG. 9 shows the configuration of an escape light instrument.

In this practical embodiment 1, the basic configuration of the escape light instrument is substantially the same as that of the aforementioned prior art embodiment illustrated in FIG. 9 except that a specific fluorescent lamp 2 is used as the light source to improve conspicuity by enhancing the luminance of the sign face of an escape light panel 1.

The fluorescent lamp 2 in the practical embodiment 1 will be described in detail below.

The fluorescent lamp 2 to serve as the light source has to be a fluorescent lamp which mainly derives its luminescence from luminophors the peak ranges of whose luminescent wavelength are from 530 to 580 nm and from 600 to 650 nm, said luminophors having 30 nm or less of half band width, permits categorical discrimination of green and white transmitted colors used on the sign face, and has a luminous color of 5 or more in Duv.

A fluorescent lamp capable of categorical discrimination of green and white transmitted by the sign face, unlike the aforementioned fluorescent lamp according to the prior art, is provided by carrying out evaluation by adaptively developing the characteristics of general discrimination of colors by humans (categorical color perception), and optimizing the design of its spectral characteristics. Examples of such fluorescent lamp are disclosed, for instance, in the Patent Applications of the International Application Numbers PCT/JP 96/02618 and PCT/JP 98/00548 (hereinafter referred to as fluorescent lamp(s) for categorical color perception).

This fluorescent lamp for categorical color perception makes possible achievement of higher luminous efficiency than the conventional white fluorescent lamp (FL-W) or tri-band type fluorescent lamp (EX-N) mentioned above and the minimum necessary discrimination of colors by using a bi-wavelength band type emission spectrum in which lights of visible wavelength bands are concentrated in two wavelength bands. It is for the following reason that this fluorescent lamp for categorical color perception is defined to be 5 or more in Duv.

Duv (Distance from perfect radiator locus on uv coordinates) is equal to 1,000 times the chromaticity deviation ($\Delta uv$), which is the distance of a given light color from the blackbody radiation locus on a CIE 1960 uv chromaticity diagram. The chromaticity deviation is assigned a plus sign when it is above the blackbody radiation locus, or a minus sign when it is below the locus.

The conventional white fluorescent lamp (FL-W) or tri-band type fluorescent lamp (EX-N) mentioned above are developed with consideration, from the viewpoint of evaluating color rendering properties, for the prevention of the chromaticity coordinates of the light color of the conventional fluorescent lamp from considerably deviating toward the plus side of Duv.

Further, as the Japanese Industrial Standards (JIS) prescribing the chromaticity classes of the light colors of fluorescent lamps, define the limit line near the blackbody radiation locus, considering this JIS definition, the vertical width of Duv is 10 to 19. Conventional fluorescent lamps deviate in Duv toward the plus side by at most 5. They are developed to be as close as practicable to 0 in Duv.

However, since the larger the Duv is, the higher the efficiency becomes, fluorescent lamps for categorical color perception are freely designed to be at least 0 in Duv, more specifically at least 5, which is the upper limit for conventional fluorescent lamps for general illumination use, or at least 10 or preferably more than 15 or more than 20 or more than 25, by intentionally reinforcing the emission of greenish light, which is higher in relative luminous efficiency, to achieve higher efficiency so that colors can be distinguished efficiently and sufficiently to satisfy the minimum requirement.

Further, whereas JIS Z 9112 "Classification of Fluorescent Lamps by Light Source Color and Color Rendering" provides for five different chromaticity ranges for conventional fluorescent lamps including daylight, neutral, cool white, warm white and incandescent, the aforementioned fluorescent lamp for categorical color perception is designed, preferably for its characteristics, to preferably have a chromaticity value above the line connecting the upper limits of these chromaticity ranges.

Raising Duv to such a high level, the greenish content, which is higher in relative luminous efficiency, increases to enhance the efficiency of light emission. A fluorescent lamp for categorical color perception having such a configuration, though achieving a high efficiency of light emission, loses the fidelity of subtle color reproduction, and can discriminate colors only roughly.

However, as the sign face of an escape light instrument consists only of a white part 1*a* and a green part 1*b*, but need not subtly reproduce many different colors as a white fluorescent lamp for general illumination use does need. Rather, if a white fluorescent lamp for general illumination use is employed, more power will be needed to increase the luminance of the sign face, resulting in inferior efficiency.

Therefore, by using a fluorescent lamp for categorical color perception which is capable of discriminating white and green and moreover is highly efficient, a more efficient escape light instrument than is provided by the prior art can be realized.

As luminophors to be used in the aforementioned fluorescent lamp for categorical color perception, ones the peak ranges of whose luminescent wavelength are from 530 to 580 nm and from 600 to 650 nm are chosen.

Luminophors the peak range of whose luminescent wavelength is from 530 to 580 nm include, for instance, a luminophor whose composition is $LaP_2O_4$: Ce, Tb (hereinafter abbreviated to LAP), while luminophors the peak range of whose luminescent wavelength is from 600 to 650 nm include a luminophor whose composition is $Y_2O_3$:Eu (hereinafter abbreviated to YOX) instead of the above-cited LAP.

As described above by using as the light source of an escape light instrument a fluorescent lamp for categorical color perception the peak ranges of whose luminescent wavelength are from 530 to 580 nm and from 600 to 650 nm, which is capable of discriminating the white and green colors transmitted by the sign face and has a luminous color of 5 or more in Duv, power consumption of the light guide instrument, which as a rule are required to be on 24 hours a day, can be substantially reduced while keeping a comparable level of conspicuity as conventional escape light instruments.

Or when conspicuity equivalent to that of the conventional light guide instrument is realized in the present instrument, the luminance on the sign face is higher and then the area of the sign face can be made small. Such compact instrument can suppress disharmony with the interior design of the indoor environment.

Practical Embodiment 2

In this practical embodiment 2, the basic configuration of the escape light instrument is substantially the same as that of the above-described practical embodiment 1 except that the perceived whiteness of the sign face is enhanced.

In a fluorescent lamp 2 configured in substantially the same way as its counterpart in the above-described practical embodiment 1, which serves as the light source, a luminophor the peak range of whose luminescent wavelength is from 420 to 470 nm is further used to suppress the yellowish tone of the white part la of an escape light panel 1.

This luminophor emits a blue light color, and by using such a luminophor the perceived whiteness of the sign face of the escape light can be enhanced. However, as a blue luminophor is subject to intense deterioration, addition of this luminophor more than needed would be a disadvantage to keeping the quality of the fluorescent lamp constant throughout its service life.

Therefore, by varying the blending ratio for a monochromatic lamp using different luminophors including LAP the peak range of whose luminescent wavelength is from 530 to 580 [nm] and whose chromaticity values (x, y) are 0.3323 and 0.5397, YOX the peak range of whose luminescent wavelength is from 600 to 650 [nm] and whose chromaticity values (x, y) are 0.5963 and 0.3321, and SCA the peak range of whose luminescent wavelength is from 420 to 470 [nm] and whose chromaticity values (x, y) are 0.1561 and 0.0792, the limit beyond which yellowish chromaticness disappears and whiteness begins to be perceived was identified by a subjective evaluation test. The number of subjects was four, and the test was conducted three times.

Table 1 shows the average mixed luminance ratio (%) of different light sources at which all the subjects begin to perceive whiteness and standard deviations among the subjects. From Table 1, it can be said that, because the standard variations indicating the degree of fluctuations of the result of this experiment are small, the light sources (i) through (m) are fluorescent lamps having spectral distributions at which all the subjects begin to feel the loss of chromaticness and perceive whiteness.

Mixed luminance ratio of different light sources at which chromaticness disappears and whiteness begins to be perceived, and standard deviations of the subjects

| | Luminance ratio of LAP (%) Standard deviation | Luminance ratio of YOX (%) Standard deviation | Luminance ratio of SCA (%) Standard deviation |
|---|---|---|---|
| Light source (i) | 95.84<br>0.58 | 0.00<br>— | 4.16<br>0.58 |
| Light source (j) | 91.60<br>1.23 | 4.57<br>0.30 | 3.84<br>0.97 |
| Light source (k) | 87.5<br>1.40 | 8.68<br>0.06 | 3.81<br>1.46 |
| Light source (l) | 82.78<br>1.68 | 13.91<br>0.19 | 3.31<br>1.76 |
| Light source (m) | 78.90<br>1.04 | 17.66<br>2.58 | 3.44<br>1.79 |

Table 2 shows the chromaticity values x and y, correlated color temperatures and Duv levels of the light sources (i) through (m).

TABLE

Experimental results of mixed luminance ratio of different light sources at which chromaticness disappears and whiteness begins to be perceived, chromaticity values x and y, correlated color temperatures Duv

| | LAP:YOX:SCA (Luminance ration: %) | x | y | Correlated color temperature [K] | Duv |
|---|---|---|---|---|---|
| Light source (i) | 95.84:0.00:4.16 | 0.2966 | 0.4474 | 6494 | 59 |
| Light source (j ) | 91.60:4.57:3.84 | 0.3162 | 0.4439 | 5953 | 50 |
| Light source (k) | 87.51:8.68:3.81 | 0.3304 | 0.4339 | 5576 | 41 |
| Light source (l) | 82.78:13.91:3.31 | 0.3506 | 0.4314 | 5041 | 33 |
| Light source (m) | 78.90:17.66:3.44 | 0.3615 | 0.4174 | 4722 | 24 |

From these values is derived a regression line ($y=-0.43x+0.60$) on the chromaticity coordinates x and y. Therefore it was revealed that, in order to keep the chromaticity value of a fluorescent lamp for categorical color perception in a range not higher than the regression line ($y<-0.43x+0.60$), a luminophor the peak range of whose luminescent wavelength is from 420 to 530 [nm] should be added in a proportion of no less than 4% of the total luminous flux.

Furthermore, since the luminophor the peak range of whose luminescent wavelength is from 420 to 470 nm is the lowest in luminous efficiency, in order to realize higher efficiency than the conventional lamp (white fluorescent lamp or tri-band type fluorescent lamp), the luminous flux derived from the luminophor the peak range of whose luminescent wavelength is from 420 to 470 nm had to be kept within 10% of the total luminous flux deriving from the luminophors the peak ranges of whose luminescent wavelength are from 530 to 580 nm and from 600 to 650 nm.

Thus, by using as the light source of an escape light instrument a fluorescent lamp for categorical color perception which achieves main light emission with luminophors the peak ranges of whose luminescent wavelength are from 530 to 580 nm and from 600 to 650 nm, supplements them with a luminophor the peak range of whose luminescent wavelength is from 420 to 470 nm in a proportion of 4 to 10% of the total luminous flux of the range of the aforementioned main luminescent wavelength, is capable of categorically discriminating the white and green colors transmitted by the sign face and has a luminous color of 5 or more in Duv, the yellowish tone of the white part 1*a* of the escape light 1 can be kept less than in the corresponding part of the fluorescent lamp for categorical color perception in the above-described (practical embodiment 1), and a satisfactory sign can be realized.

Luminophors the peak range of whose luminescent wavelength is from 420 to 470 nm, said luminophors having 30 nm or less of half band width, include, for instance, BAM whose composition is $BaMg_2Al_{16}O_{27}$:Eu, SCA whose composition is (Sr, Ba, Ca,)$_{10}(PO_4)_6Cl_2$:Eu, SAE whose composition is $Sr_4Al_{14}O_{25}$:Eu, BAT whose composition is $BaMgAl_{10}O_{17}$:Eu, and S-BAT whose composition is (Ba,Sr) $MgAl_{10}O_{17}$:Eu,Mn.

Specific examples of the above-described practical embodiment 1 and practical embodiment 2 will be given below.

Embodiment 1

Using a luminophor LAP the peak range of whose luminescent wavelength is from 530 to 580 nm and a luminophor YOX the peak range of whose luminescent wavelength is from 600 to 650 nm, fluorescent lamps TL1 and TL2 for categorical color perception having a luminous color of 5 or more in Duv as mentioned above were respectively prepared as fluorescent lamps for categorical color perception in the above described practical embodiment 1. TL2 has a smaller proportion of LAP and a greater proportion of YOX than TL1.

Further as another fluorescent lamp for categorical color perception in the above described practical embodiment 2, a fluorescent lamp TL3 for categorical color perception was prepared by adding another luminophor SCA to the aforementioned LAP and YOX.

The luminous flux ratios of LAP and other luminophors in the fluorescent lamps TL2 and TL3 for categorical color perception are substantially equal.

The above-described fluorescent lamps TL1 through TL3 for categorical color perception, a luminophor LAP for comparison, a white fluorescent lamp (FL-W) and a tri-band type fluorescent lamp (EX-N) as conventional fluorescent lamps were built into escape light instruments as illustrated in FIG. 9 as the fluorescent lamps 2, and the spectral distribution in each case was measured.

The measurement results that are obtained are shown in FIGS. 1(*a*) through (*f*)

FIG. 1(*a*) shows the spectral distribution of the fluorescent lamp TL for categorical color perception; FIG. 1(*b*), that of the fluorescent lamp TL2 for categorical color perception; FIG. 1(*c*), that of the fluorescent lamp TL3 f or categorical color perception; FIG. 1(*d*) , that of the luminophor LAP; FIG. 1(*e*), that of the white fluorescent lamp (FL-W); and FIG. 1(*f*), that of the tri-band type fluorescent lamp (EX-N).

FIGS. 1(*a*), (*b*) and FIGS. 1(*e*), (*f*) suggest as if the fluorescent lamps TL1 and TL2 for categorical color perception had fewer blue mercury emission lines in the 420 to 470 nm range than the white fluorescent lamp (FL-W) and the tri-band type fluorescent lamp (EX-N), but they are relative values, reflecting differences in peak level, about 440 nm or about 550 nm, and substantially equal in absolute value.

Embodiment 2

Figure 2:
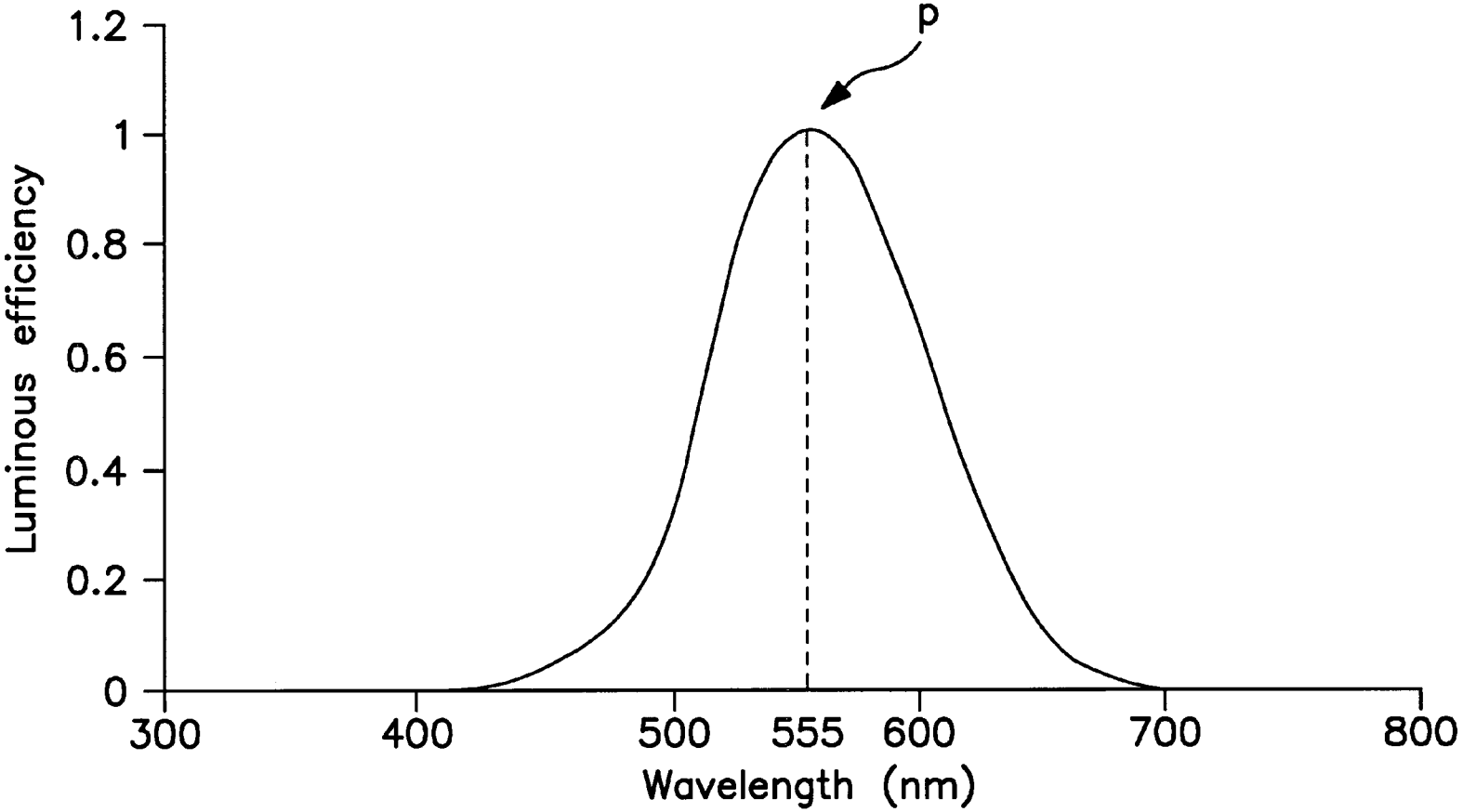
FIG. 2 shows relative luminous efficiency characteristics.

The relative luminous efficiency curve in human photopic vision relativized at a peak height of 1 is shown in FIG. 2.

Since the peak p of the spectral luminous efficacy curve is observed at 555 nm as shown in FIG. 2, the use of a fluorescent lamp having the peak of its luminescent wavelength at or around this value, among the fluorescent lamps prepared for the above-described embodiment 1, enhances the luminance of the sign face of the escape light instrument.

Embodiment 3

The fluorescent lamps prepared for the above-described embodiment 1 were set in the escape light instrument shown in FIG. 9, and the luminance of the white part 1*a* of the sign face in each case was measured. The relative luminance ratio of each was determined with reference to the luminance of the conventional white fluorescent lamp (FL-W) being represented by 1.

The higher the relative luminance ratio, the brighter the lamp is perceived to be, and the higher the luminous efficiency relative to-the conventional white fluorescent lamp (FL-W) with the same power consumption.

Figure 3:
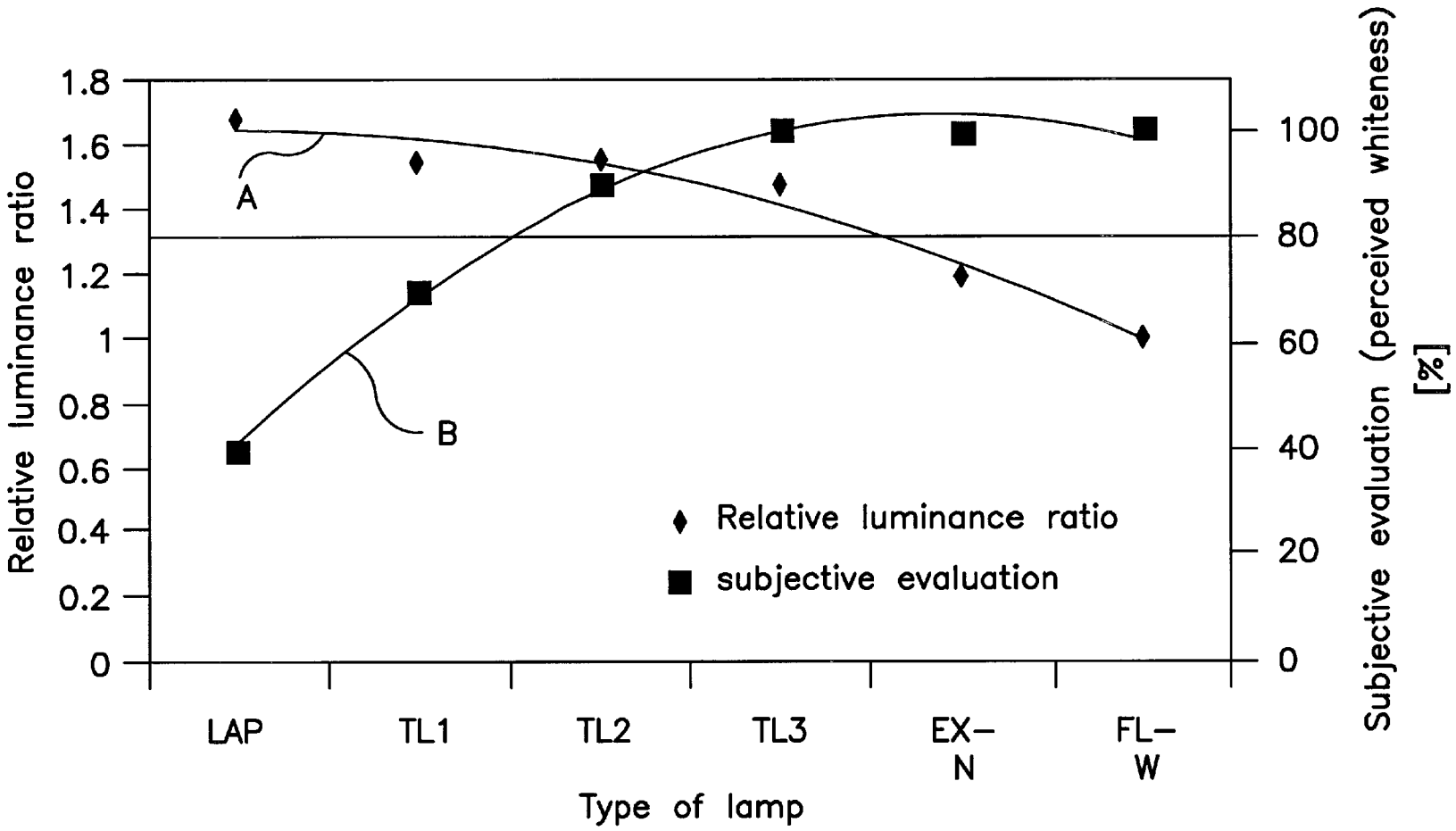
FIG. 3 shows the relative luminance ratio and subjective evaluation.

The determined relative luminance ratios are plotted in FIG. 3, marked with ♦ and traced with curve A.

As shown in FIG. 3, the fluorescent lamps TL1, TL2 and TL3 for categorical color perception are higher in relative luminance ratio and in luminous efficiency than the white fluorescent lamp (FL-W) and tri-band type fluorescent lamp (EX-N).

It is further seen that the fluorescent lamp with a luminophor only of LAP manifested the highest relative luminance ratio and that, in the fluorescent lamps TL1 through TL3 for categorical color perception, the higher the LAP content, the higher the relative luminance ratio. These findings are attributable to the following reasons.

As the above-described embodiment 2 reveals, since the peak p of the spectral luminous efficacy curve, which is an indicator of brightness, is at 555 nm, the closer the peak of luminescent wavelength to 555 nm, the higher the relative luminance ratio among the measured spectral distributions shown in FIGS. 1(*a*) through (*f*). As shown in FIG. 1(*d*), the luminophor of LAP has its highest peak h at 555 nm, and accordingly gives the highest level of brightness. Further, as shown in FIG. 1(*a*), the fluorescent lamp TL1 for categorical color perception, though it also has its highest peak a at 555 nm, its relative luminance is less than that of the luminophor of LAP because it also has a higher peak d then the peak b between 600 and 650 nm. As shown in FIG. 1(*b*), the fluorescent lamp TL2 for categorical color perception, though it also has its highest peak c at 555 nm, its relative luminance is less than that of the fluorescent lamp TL1 for categorical color perception because it also has a higher peak d than the peak b between 600 and 650 nm.

As shown in FIG. 1(*c*), the relative luminance of the fluorescent lamp TL3 for categorical color perception is less than that of the fluorescent lamp TL2 for categorical color perception because it also has a peak f between 600 and 650 nm and a peak g between 420 and 470 nm in addition to its highest peak e in the vicinity of 555 nm.

Accordingly, among the fluorescent lamps TL1 through TL3 for categorical color perception, the higher the LAP content, the higher the relative luminance ratio.

Thus it is evident that, by using a fluorescent lamp for categorical color perception as in the above-described practical embodiment 1 and practical embodiment 2, an escape light instrument of high luminous efficiency can be obtained.

Embodiment 4

The fluorescent lamps prepared for the abovedescribed embodiment 1 were set in the escape light instrument shown in FIG. 9, and the perceived whiteness of the sign face of the escape light instrument in each case was subjectively evaluated.

For the subjective evaluation, 10 subjects evaluated the perceived whiteness of the white part 1*a*, and the relative count of the evaluation by each subject was taken with the perceive whiteness of the white fluorescent lamp (FL-W) being represented by 100%.

The evaluation counts that were obtained are plotted in FIG. 3, marked with ■ and traced with curve B.

While the above-described embodiment 3 gave the results that the luminophor only of LAP manifested the highest relative luminance ratio and that, in the fluorescent lamps TL1 through TL3 for categorical color perception, the higher the LAP content, the higher the relative luminance ratio, the instrument with the luminophor only of LAP gave a greenish impression with the loss of perceived whiteness in this subjective evaluation of embodiment 4, and most of the subjects replied that the white part la of the sign face of the escape light did not look white.

However, fluorescent lamps TL1 through TL3 for categorical color perception, each of which was provided with another luminophor in addition to one of LAP alone, won high marks of subjective evaluation, 60% or more.

To add, although FIG. 3 makes no mention of subjective evaluation of how the color of the green part 1*b* of the sign face of the escape light instrument looks, the subjects replied that the green part 1*b* did look green.

Further, with a view to finding out a suitable luminous flux ratio for LAP, other luminophors including YOX were added to LAP, and their contents were adjusted, giving the finding that blending of LAP with other luminophors in a luminous flux ratio of approximately 80:20 would result in a perceived whiteness count of about 80% or more.

The foregoing findings indicate that it is made possible to discriminate white and green on the sign face and achieve the maximum luminance with no more power consumption than according to the prior art by using in an escape light instrument a fluorescent lamp for categorical color perception in which the luminous flux ratio between LAP and other luminophors is 80:20.

Previous research has revealed that higher luminance provides higher conspicuity, which is essential for guiding people when taking refuge.

As any conventional escape light instrument is somewhat lower in luminance, the luminance of its sign face and its conspicuity can be enhanced by merely replacing its lamp with a fluorescent lamp according to the present invention.

However, too high luminance may invite a veiling phenomenon which would prevent recognition of the displayed message. For this reason, further research is under way, which has so far given the finding that the level of conspicuity is determined by the product of the sign area and luminance. The rule book JIL 5502 (regarding technical standards on escape light instruments) of the Association of Japanese Manufacturers of instruments prescribes the range of required luminance relative to the size of the sign face.

These findings reveal that, because the range of required luminance is determined by the size of the sign face, a high luminance fluorescent lamp for categorical color perception can be effectively used at a low wattage, and power consumption could then be correspondingly reduced to contribute-to energy conservation.

Whereas smaller escape light instruments are increasingly preferred with a view to harmonization with the interior design, the use of fluorescent lamps for categorical color perception enables a high level of luminance to be achieved at a low wattage and the fluorescent lamps themselves to be reduced in size.

Practical Embodiment 3

Figure 4A:
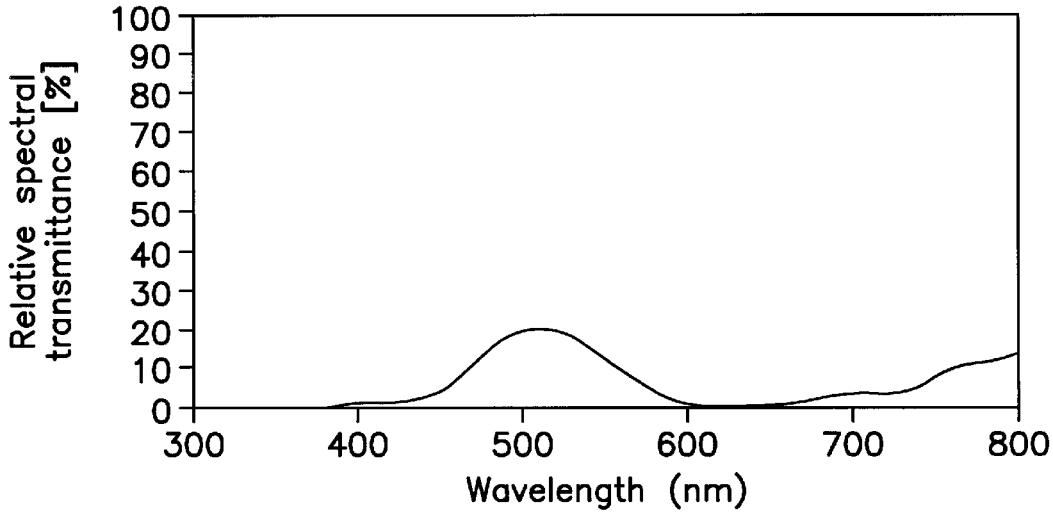
FIG. 4 shows spectral transmittance characteristics.
Figure 4B:
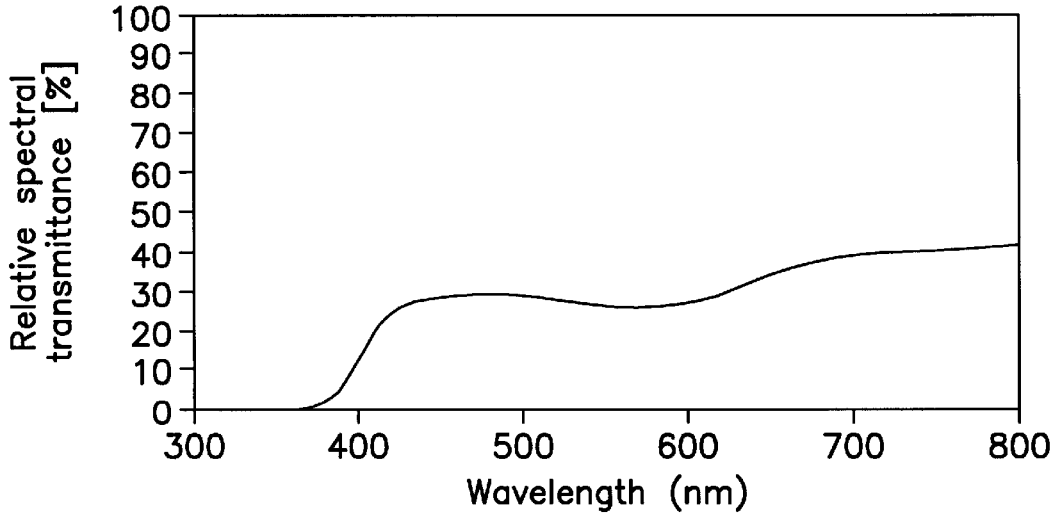
Figure 5A:
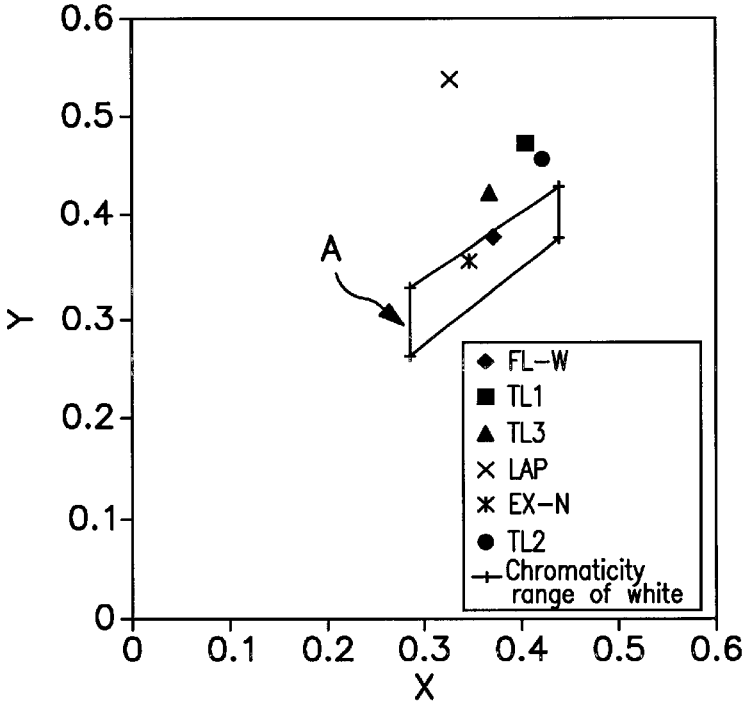
FIG. 5 shows chromaticity coordinates x and y.
Figure 5B:
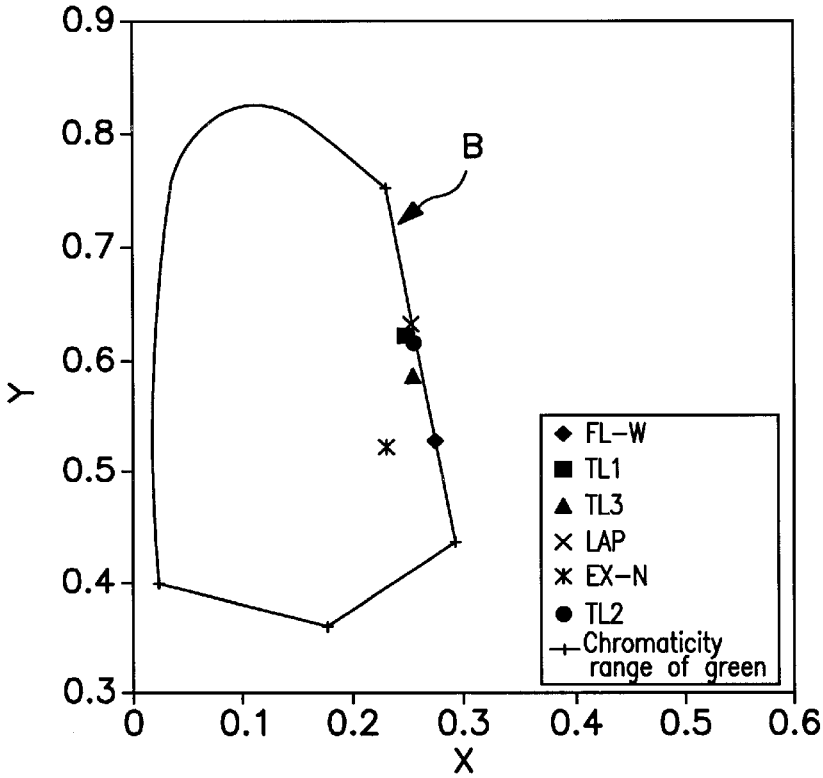

The basic configuration of this practical embodiment 3 is substantially the same as in the above described practical embodiment 1 and practical embodiment 2 except that the chromaticity values of the white and green transmitted colors of the sign part of the escape light instrument are regulated to satisfy the requirements of JIS Z 9104 (General Rules on the Use of Safety Color Lights) FIG. 4 and FIG. 5 illustrate the practical embodiment 3 of the present invention.

FIG. 4(*a*) shows the spectral transmittance of the white part 1A of the escape light panel, and FIG. 4(*b*), that of the green part 1*b*.

From these spectral transmittance curves shown in FIGS. 4(*a*) and(*b*) and the spectral distribution curves shown in FIGS. 1(*a*) through (*f*), the chromaticity values of the colors transmitted by the sign face when each type of fluorescent lamp 2 is built into the escape light instrument were calculated.

The calculated chromaticity values of the white part 1*a* and the green part 1*b* of the escape light panel are shown in FIGS. 5(*a*) and(*b*) respectively.

To add, frame A in FIG. 5(*a*) and frame B in FIG. 5(*b*) are the chromaticity ranges of white and green, respectively, prescribed by JIS Z 9104.

As shown in FIG. 5(*a*), while the white transmitted colors in the conventional white fluorescent lamp (F-LW) and tri-band type fluorescent lamp (EX-N) are within frame A, which shows the prescribed range for white, those of the fluorescent lamps TL1 through TL3 for categorical color perception according to the present invention and of the luminophor of LAP are outside frame A, and the green colors transmitted by all the fluorescent lamps are within frame B, which is the prescribed range for green as shown in FIG. 5(*b*).

It seems that, as the JIS-prescribed ranges mentioned above refer to the ranges to which the conventional white fluorescent lamp (FL-W) and tri-band type fluorescent lamp (EX-N) are applied, the fluorescent lamps TL1 through TL3 for categorical color perception according to the invention are outside one of the prescribed ranges.

However, as shown in FIG. 3, according to the findings of the subjective evaluation test to which embodiment 4 was subjected, the fluorescent lamps TL2 and TL3 for categorical color perception can give white transmitted colors which are adequate to be perceived as white.

Therefore even a fluorescent lamp outside this frame A, which shows the prescribed range for white, can be used even though it is outside the JIS-prescribed range if the color difference from this prescribed range $[\sqrt{((\Delta x)^2+\sqrt{(\Delta y)^2})}]$ is within 0.07.

However, since JIS rules actually constitute an essential factor in obtaining authorization of any appliance, it is necessary to keep the white transmitted color of the fluorescent lamps TL2 and TL3 for categorical color perception within this range.

Therefore, it was decided to keep the chromaticity value of the white transmitted colors by altering the relative spectral transmittance of the transmissive panel instead of changing their spectrum.

Figure 6:
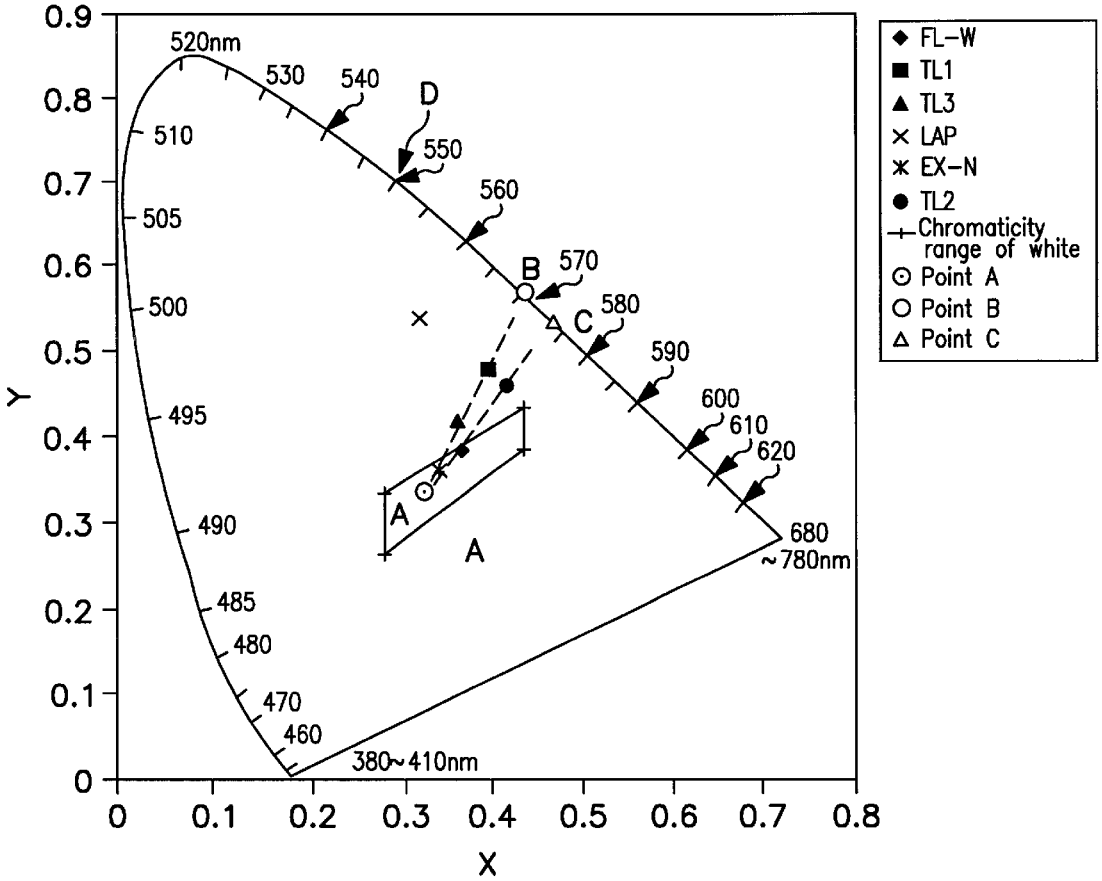
FIG. 6 shows the chromaticity coordinates x and y and spectral locus of the escape light panel.

FIG. 6 shows the chromaticity coordinates x and y in the white part on the sign face of the escape light instrument.

Arrow D represents the spectral locus; point A, the chromaticity of the equal energy spectrum; point B, the main wavelength of TL3; and point C, the main wavelength Δ of TL2.

Hereupon, for instance, point B representing the main wavelength of TL3 is the point where a line connecting point A representing the equal energy white chromaticity and a point indicating the chromaticity of TL3 (represented by a black triangle in FIG. 6) crosses the spectral locus D. The point indicating the chromaticity of TL3 (represented by a black triangle in FIG. 6), as it is on line AB, can be obtained by appropriately mixing white stimuli A and monochromatic stimuli B. Conversely, this means that the chromaticity value of a given color can be brought closer to the chromaticity of white by reducing the monochromatic stimuli B of that color to the white stimuli A.

Therefore, it was attempted to keep the chromaticity range of the white transmitted color within the prescribed extent represented by frame A by realizing a white part 1*a* of the transmissive panel the spectral transmittance of whose 485 to 585 nm yellow to bluish green spectrum, including the main wavelength 573 nm of TL2 and the main wavelength 570 nm of TL3, obtained in the same manner as described above, was reduced.

Thus the spectral transmittance of the white part of the translucent cover of the escape light instrument in the 485 to 585 nm range was made equal to 60 to 100% of its average spectral transmittance in the 380 to 780 nm range.

A specific example of this disposition is given below.

Figure 7:
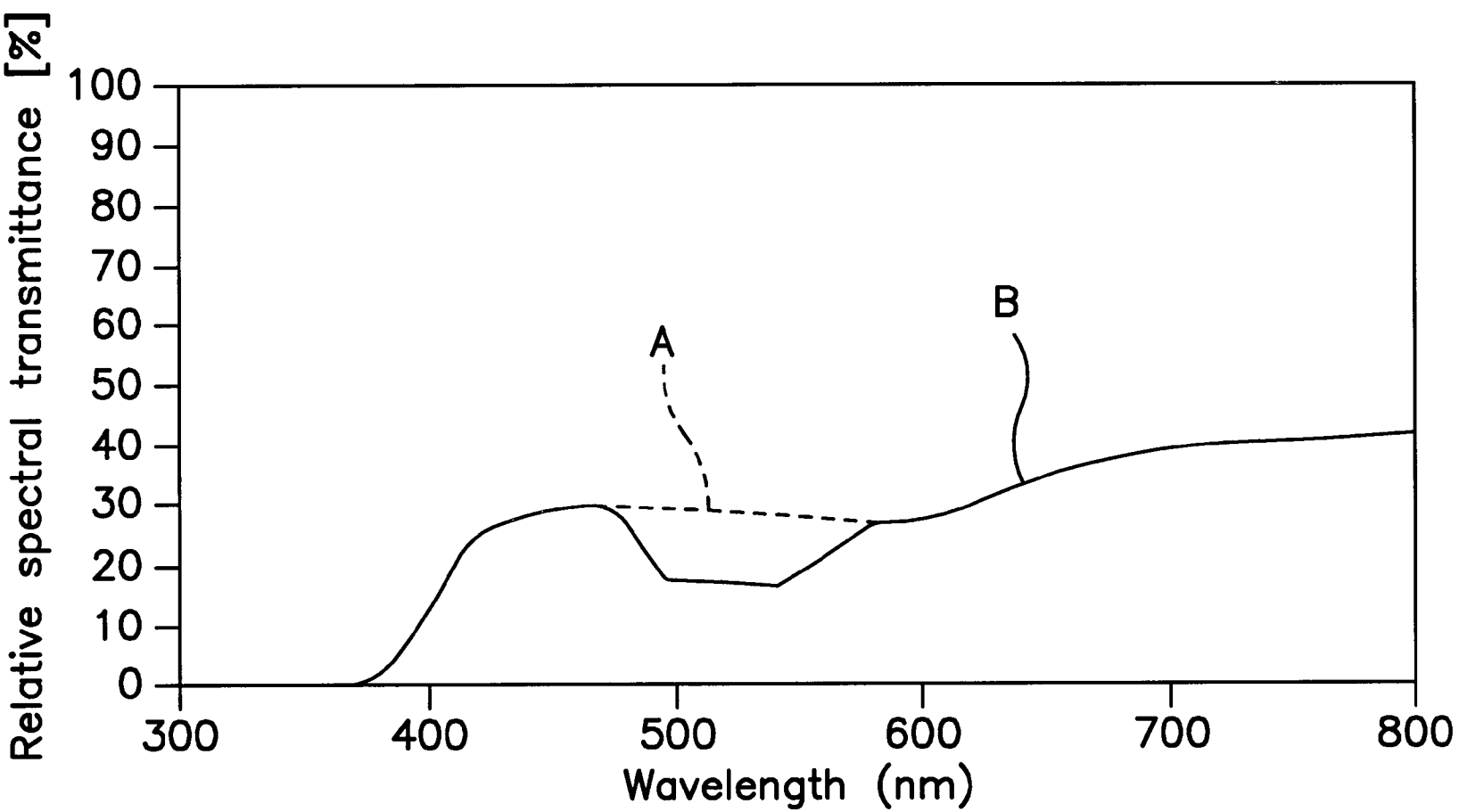
FIG. 7 shows the spectral transmittance characteristics of the escape light panel.

FIG. 7 shows the relative spectral transmittance of the escape light panel.

Broken line A represents the conventional spectral transmittance while solid line B represents the spectral transmittance in the 485 to 585 nm range equal to 60 to 100% of the average spectral transmittance in the 380 to 780 nm range.

As illustrated in FIG. 7, the spectral transmittance of the white part of the translucent cover of the escape light instrument in the 485 to 585 nm range was made equal to 60 to 100% of its average spectral transmittance in the 380 to 780 nm range.

Figure 8A:
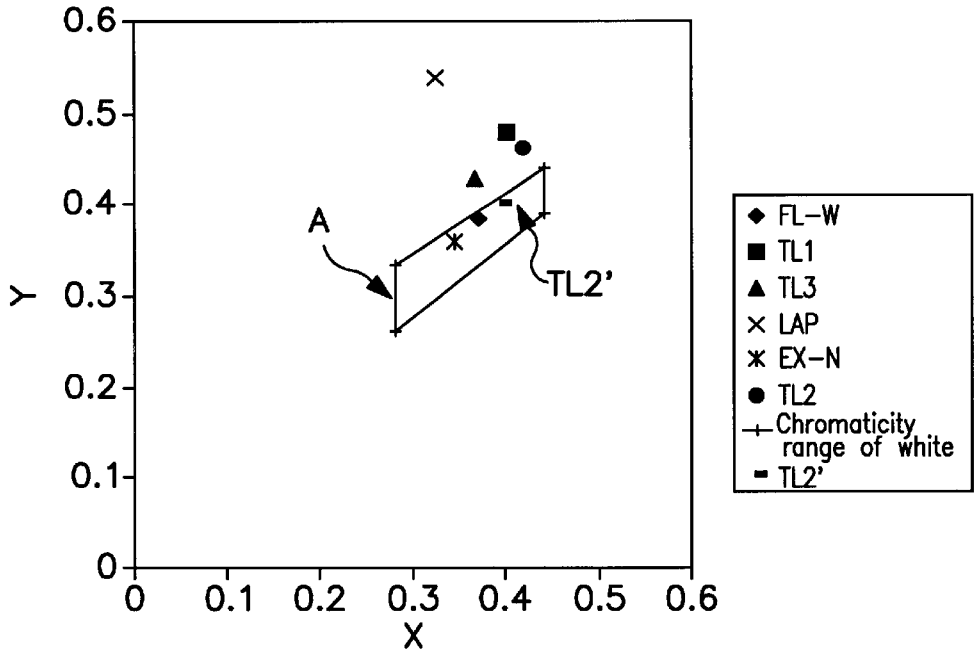
FIG. 8 shows the chromaticity coordinates x and y of the escape light panel.
Figure 8B:
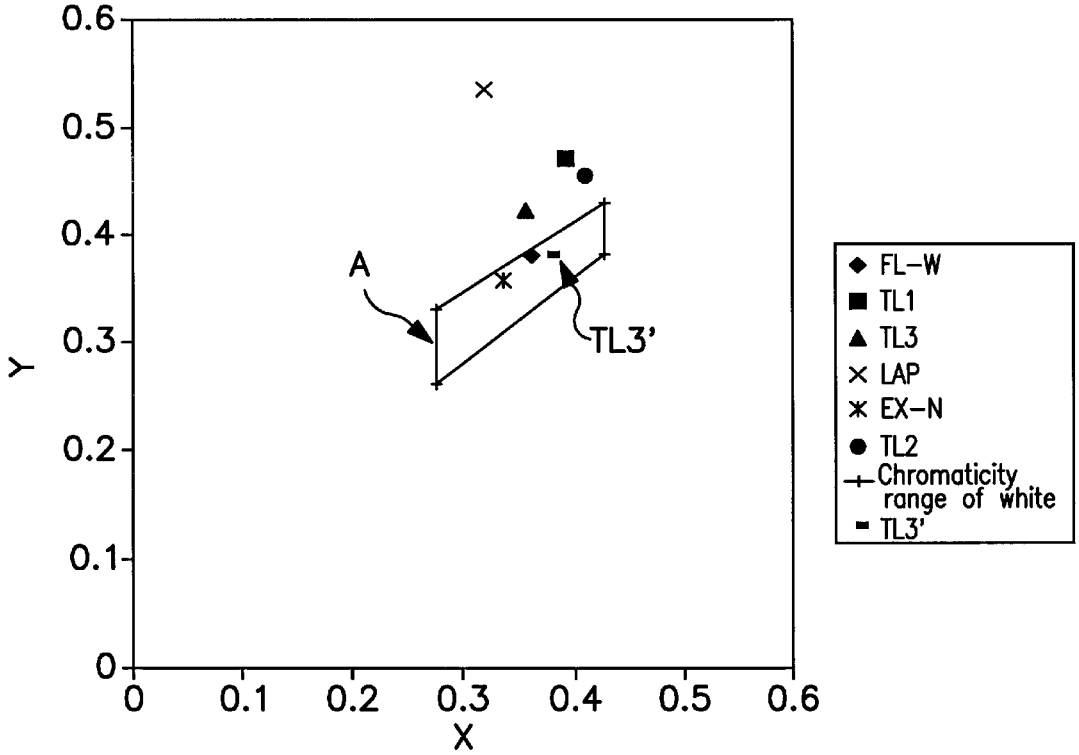

The measured results are shown in FIG. 8.

As shown in FIG. 8(*a*) the chromaticity value of TL2 has changed to TL2' and, as shown in FIG. 8(*b*), that of TL3 has changed to TL3', both within area A which is within the prescribed chromaticity range of white.

Materials having a spectral transmittance curve as shown in FIG. 7 include a thin magenta-colored filter. By sticking this color filter to durable glass or synthetic resin, the transmitted color of an escape light using a fluorescent lamp for categorical color perception can be kept within the chromaticity range of white.

To add, a similar effect can as well be achieved by mixing a pigment into glass or synthetic resin.

The foregoing reveals that, by altering the spectral transmittance of the translucent panel of the escape light, the white transmitted color of the fluorescent lamp for categorical color perception can be kept within the JIS-prescribed range.

Incidentally, although the fluorescent lamp 2 is arranged behind the escape light panel 1 in every practical embodiment described above, the present invention is not restricted to this arrangement, but can as well be applied to an edge light type, for instance, in which the fluorescent lamp 2 is disposed on the edge of the escape light panel 1.

According to claim 1 of the invention, it is possible to enhance the luminance of the sign face and conspicuity. Or where the luminance of the sign face of a conventional escape light is sufficient, energy consumption can be saved by dimming or using a lamp of a low wattage. Furthermore, as a lamp of a low wattage is small, the escape light can be reduced in size to facilitate harmonization with the interior design.

According to claim 2 of the invention, it is possible to suppress the yellowish tone of the white part of the sign face and achieve satisfactory white marking in addition to the above-noted effect.

According to claim 3 of the invention, it is possible, besides as claimed in claim 1 or 2, to keep the chromaticity values of the white and green transmitted colors of the sign face of the escape light within the range prescribed by JIS Z 9104.

According to claim 4 of the invention, it is possible to enhance the luminance of the sign face and conspicuity without consuming any more power than a conventional apparatus, because a fluorescent lamp of high luminous efficiency is used. Or where no more luminance than the sign face of a conventional escape light instrument is required, the power consumption of the escape light instrument, which as a rule is required to be on 24 hours a day, can be minimized because a fluorescent lamp of a lower wattage can be used. Further, where a smaller escape light instrument is required, an even smaller escape light instrument than expected can be provided because the requirement can be well met by a fluorescent lamp of a smaller wattage, resulting in an escape light instrument in good harmony with the interior design.

According to claim 5 of the invention, it is possible, besides as claimed in claim 4, to reduce blue which is subject to intense deterioration and keep the quality of the fluorescent lamp constant throughout its service life by reducing the blue emitting luminous flux of the fluorescent lamp.

What is claimed is:

1. An escape light instrument comprising:

a fluorescent lamp that mainly derives its luminescence from luminophors the peak ranges of whose luminscent wavelength are from 530 to 580 mn and from 600 to 650 nm, said luminophors having a half band width of 30 nm or less; and a transmittive cover that covers said fluorescent lamp, said transmittive cover comprising a sign face, said sign face comprising a green part and a white part;

wherein:

a categorical discrimination of at least green and white transmitted colors used in said sign face is permitted, and said fluorescent lamp has a luminous color of 5 or more in Duv.

2. The escape light instrument of claim 1 wherein a spectral transmittance between 485 to 585 nm of the white part of the transmissive cover of the escape light instrument is lower than the average spectral transmittance between 380 to 780 nm of said white part of said transmissive cover.

3. The escape light instrument of claim 1 wherein the luminophor the peak range of whose luminscent wavelength is from 530 to 580 nm is $LaP_2O_4$:Ce,Tb, and the luminophor the peak range of whose luminscent wavelength is from 600 to 650 nm is $Y_2O_3$:Eu.

4. An escape light instrument comprising:

a fluorescent lamp that mainly derives its luminescence from luminophors the peak ranges of whose luminscent wavelength are from 530 to 580 nm and from 600 to 650 nm, said luminophors having a half band width of 30 nm or less; and a transmittive cover that covers said fluorescent lamp, said transmittive cover comprising a sign face, said sign face comprising a green part and a white part;

wherein:

a luminous flux derived from a luminophor the peak range of whose luminescent wavelength is from 420 to 470 nm comprises 4 to 10% of the total luminous flux in said luminescent wavelength from 530 to 580 nm and said luminscent wavelength from 600 to 650 nm, and categorical discrimination of at least green and white transmitted colors used in said sign face is permitted, and said fluorescent lamp has a luminous color of 5 or more in Duv.

5. The escape light instrument of claim 4 wherein a spectral transmittance between 485 to 585 nm of the white part of the transmissive cover of the escape light instrument is lower than the average spectral transmittance between 380 to 780 nm of said white part of said transmissive cover.

6. The escape light instrument of claim 5 wherein a blue emitting luminous flux of the fluorescent lamp that mainly derives its luminescence from luminophors the peak ranges of whose luminscent wavelength are from 530 to 580 nm and from 600 to 650 nm is reduced against a tri-band type fluorescent lamp having a correlated color temperature equivalent to that of said fluorescent lamp that mainly derives its luminescence from luminophors the peak ranges of whose luminscent wavelength are from 530 to 580 nm and from 600 to 650 nm.

7. The escape light instrument of claim 4 wherein the luminophor the peak range of whose luminscent wavelength is from 530 to 580 nm is $LaP_2O_4$:Ce,Tb, and the luminophor the peak range of whose luminscent wavelength is from 600 to 650 nm is $Y_2O_3$:Eu.

8. The escape light instrument of claim 7 wherein the luminophor the peak range of whose luminescent wavelength is from 420 to 470 nm is selected from the group consisting of $BaMg_2Al_{16}O_{27}$:Eu, $(Sr,Ba,Ca)_{10}(PO_4)_6Cl_2$:Eu, $Sr_4Al_{14}O_{25}$:Eu, $BaMgAl_{10}O_{17}$:Eu, and $(Ba,Sr)MgAl_{10}O_{17}$:Eu,Mn.

9. The escape light instrument of claim 8 wherein a spectral transmittance between 485 to 585 nm of the white part of the transmissive cover of the escape light instrument is lower than the average spectral transmittance between 380 to 780 nm of said white part of said transmissive cover.

10. The escape light instrument of claim 4 wherein the luminophor the peak range of whose luminescent wavelength is from 420 to 470 nm is selected from the group consisting of $BaMg_2Al_{16}O_{27}$:Eu, $(Sr,Ba,Ca)_{10}(PO_4)_6Cl_2$:Eu, $Sr_4Al_{14}O_{25}$:Eu, $BaMgAl_{10}O_{17}$:Eu, and $(Ba,Sr)MgAl_{10}O_{17}$:Eu,Mn.

* * * * *